US006524501B1

(12) United States Patent
Arai et al.

(10) Patent No.: US 6,524,501 B1
(45) Date of Patent: Feb. 25, 2003

(54) PITCH FIBER BUNDLE AND PITCH TYPE CARBON FIBER BUNDLE AND METHOD FOR PRODUCTION THEREOF

(75) Inventors: Yutaka Arai, Hyogo (JP); Yoshiyuki Doken, Hyogo (JP); Tsutomu Nakamura, Hyogo (JP)

(73) Assignees: Nippon Steel Corporation, Tokyo (JP); Nippon Mitsubishi Oil Corporation, Tokyo (JP); Nippon Graphite Fiber Corporation, Tokyo (JP)

( * ) Notice: Subject to any disclaimer, the term of this patent is extended or adjusted under 35 U.S.C. 154(b) by 238 days.

(21) Appl. No.: 09/657,780

(22) Filed: Sep. 8, 2000

Related U.S. Application Data

(62) Division of application No. 09/534,259, filed on Mar. 24, 2000, now Pat. No. 6,187,434.

(30) Foreign Application Priority Data

Mar. 30, 1999 (JP) ..... 11-89062
Feb. 15, 2000 (JP) ..... 2000-36684

(51) Int. Cl.[7] ..... D01F 9/145; D02J 1/18

(52) U.S. Cl. ..... 264/29.2; 57/310; 57/350; 264/29.6; 264/29.7; 264/103; 264/129; 264/130; 264/210.8; 264/211.11; 423/447.4; 423/447.6; 423/447.7; 423/447.8; 423/448

(58) Field of Search ..... 264/29.2, 29.6, 264/29.7, 103, 129, 130, 210.8, 211.11; 423/447.4, 447.6, 447.7, 447.8, 448; 57/310, 350

(56) References Cited

U.S. PATENT DOCUMENTS

| | | | | | |
|---|---|---|---|---|---|
| 4,186,179 | A | * | 1/1980 | Katsuki et al. | 423/447.4 |
| 4,466,949 | A | * | 8/1984 | Mori | 423/447.4 |
| 4,895,712 | A | * | 1/1990 | Komine et al. | 423/447.4 |
| 5,183,603 | A | * | 2/1993 | Kitajima et al. | 264/29.2 |
| 5,425,931 | A | | 6/1995 | Arai et al. | |

FOREIGN PATENT DOCUMENTS

| | | | | |
|---|---|---|---|---|
| EP | 0 825 953 A2 | | 4/1998 | |
| JP | 1-229820 A | | 9/1989 | 264/29.2 |
| JP | 1-250417 A | | 10/1989 | |
| JP | 05295620 A | * | 11/1993 | |
| JP | 6-146119 A | | 5/1994 | |
| JP | 9-273032 A | | 10/1997 | |
| JP | 10-121325 A | | 5/1998 | |

* cited by examiner

*Primary Examiner*—Leo B. Tentoni
(74) *Attorney, Agent, or Firm*—Wenderoth, Lind & Ponack, L.L.P.

(57) ABSTRACT

This invention provides a pitch fiber bundle for carbon fibers of small size, a carbon fiber bundle, and a method for the production thereof, i.e. a method for the production of carbon fibers of a small size, a pitch fiber bundle, and a carbon fiber bundle at a lower cost with higher productivity than usual. The method for the production of pitch type carbon fibers according to this invention comprises dividing a plurality of pitch fibers into not less than two bundles, intertwining the bundles by exposure to currents of air thereby forming a first fiber bundle, binding a plurality of such first fiber bundles, and again intertwining the bound pitch fiber bundles by exposure to currents of air thereby forming a second fiber bundle.

8 Claims, 6 Drawing Sheets

PITCH FIBER BUNDLE AND PITCH TYPE CARBON FIBER BUNDLE AND METHOD FOR PRODUCTION THEREOF

This application is a divisional of U.S. application Ser. No. 09/534,259 filed on Mar. 24, 2000, now U.S. Pat. No. 6,187,434.

BACKGROUND OF THE INVENTION

1. Field of the Invention

This invention relates to a pitch fiber bundle which is one kind of the precursor of carbon fibers, a pitch type carbon fiber bundle, and a method for the production thereof. Particularly, this invention relates to a pitch fiber bundle which is one kind of the precursor of carbon fibers of a small size fit for the production of woven fabrics of carbon fibers and a carbon fiber prepreg of a low areal weight ("Metsuke" in Japanese), a pitch type carbon fiber bundle, and a method for the production of carbon fibers of a small size, i.e., a method for producing, at low cost and with high operational efficiency, a pitch fiber bundle which is one kind of the precursor of carbon fibers of a small size, a pitch type carbon fiber bundle, and carbon fibers of a small size. The pitch type carbon fibers which are obtained by this invention are fit for the production of lightweight woven fabrics of carbon fibers and carbon fiber prepreg and are used advantageously in various industrial fields covering sports, leisure, and aerospace technology.

2. Description of the Related Art

The pitch type carbon fibers, like pitch fibers which are the precursor thereof, infusibilized fibers, and carbonized fibers, are weak and very difficult to handle as compared with the PAN type carbon fibers which have acrylic fibers as the precursor.

Heretofore, the production of pitch type carbon fibers of a small size has required decreasing the number of filaments during the process of spinning (or extrusion), with the result that the productivity will be conspicuously lowered and, at the same time, the necessity of handling feeble fibers of a small size will be incurred. The production of carbon fibers of a small size on a commercial scale, therefore, embraces factors for degrading productivity and boosting cost. It, therefore, has entailed the problem that lightweight woven fabrics of carbon fibers and carbon fiber prepreg have become highly expensive.

As a measure to cope with this problem, a method which obtains carbon fibers of a small size by producing a carbon fiber bundle provisionally and then dividing this bundle into several bundles has been proposed. The pitch type carbon fibers generally stretch only meagerly, however, because they possess a higher modulus of elasticity than the PAN type carbon fibers. The carbon fiber bundle, therefore, is incapable of being stably divided into smaller bundles of a prescribed size because it copiously produces broken fibers during the course of division.

JP-A-01-250,417 proposes a method which comprises paralleling and twisting not less than two fiber bundles as the precursor of the PAN type carbon fibers into a cord, doubling such cords and firing the doubled cords, and thereafter dividing the fired doubled cords into the individual carbon fiber bundle cords. The carbon fibers produced by this method, however, have the problem that they will not fit fabrication into lightweight prepregs, though they are suitable as sewing threads. Similarly JP-A-09-273,032 and EP-A-0835953 propose a fiber bundle for use in the PAN type carbon fibers, which retains the shape of one tow and permits division into a plurality of small tows prior to use. This fiber bundle, however, encounters great difficulty in being adapted for pitch type carbon fibers because it is required to allow impartation of crimps never attainable with pitch fibers and endure the impact of a winder to be used for doubling small tows.

Then, JP-A-01-229,820 proposes pitch type carbon fibers which have the number of filaments of less than 1,000. The method used for producing these fibers, however, has the problem that the component fibers are fated to succumb to agglutination. It has another problem that the productivity is prominently impaired because extremely brittle pitch fibers are doubled after the spinning which can be carried out at a relatively high speed.

SUMMARY OF THE INVENTION

This invention, with the object of improving the productivity of each of the spinning, infusibilizing, and carbonizing steps which govern the cost of production of carbon fibers of a small size, thereby allowing inexpensive production of pitch type carbon fibers of a small size, has the task of providing a pitch fiber bundle as the precursor of carbon fibers, a pitch type carbon fiber bundle, and a method for the production thereof.

The first mode of this invention provides a pitch fiber bundle which is characterized by forming a second pitch fiber bundle with not less than two first pitch fiber bundles possessing a degree of intertwining of not more than 100 mm and having the first pitch fiber bundles bound in the second pitch fiber bundle at a degree of intertwining in the range of 100 mm–5000 mm.

The second mode of this invention provides a pitch type carbon fiber bundle which is characterized by forming a second carbon fiber bundle with not less than two first carbon fiber bundles possessing a degree of intertwining of not more than 200 mm, having the first carbon fiber bundles bound in the second carbon fiber bundle at a degree of intertwining of not less than 200 mm, and enabling the second carbon fiber bundle to be divided into the first carbon fiber bundles; or a pitch type carbon fiber bundle characterized by being a first fiber bundle resulting from division of the second carbon fiber bundle.

The third mode of this invention provides a method for the production of pitch type carbon fibers by an operation of drawing pitch fibers, characterized by the steps of dividing a plurality of pitch fibers into not less than two fiber bundles, then imparting an intertwining action to the fiber bundles with a current of air thereby forming first fiber bundles, binding a plurality of first fiber bundles together, again imparting an intertwining action to the bound pitch fiber bundles with a current of air, and drawing bound pitch fibers as a second fiber bundle.

This invention, in the production of carbon fibers of a small size, manifests a veritably prominent effect of allowing carbon fibers of a small size to be produced inexpensively with high operational efficiency on a commercial scale by maintaining the same productivity as carbon fibers of a large size at the spinning, infusibilizing, and carbonizing steps which govern the cost of production of carbon fibers and eventually rendering production of carbon fibers of a small size feasible.

The above and other objects, features, and advantages of the present invention will become clear from the following description of the preferred embodiments.

DESCRIPTION OF THE PREFERRED EMBODIMENTS

Figure 1:
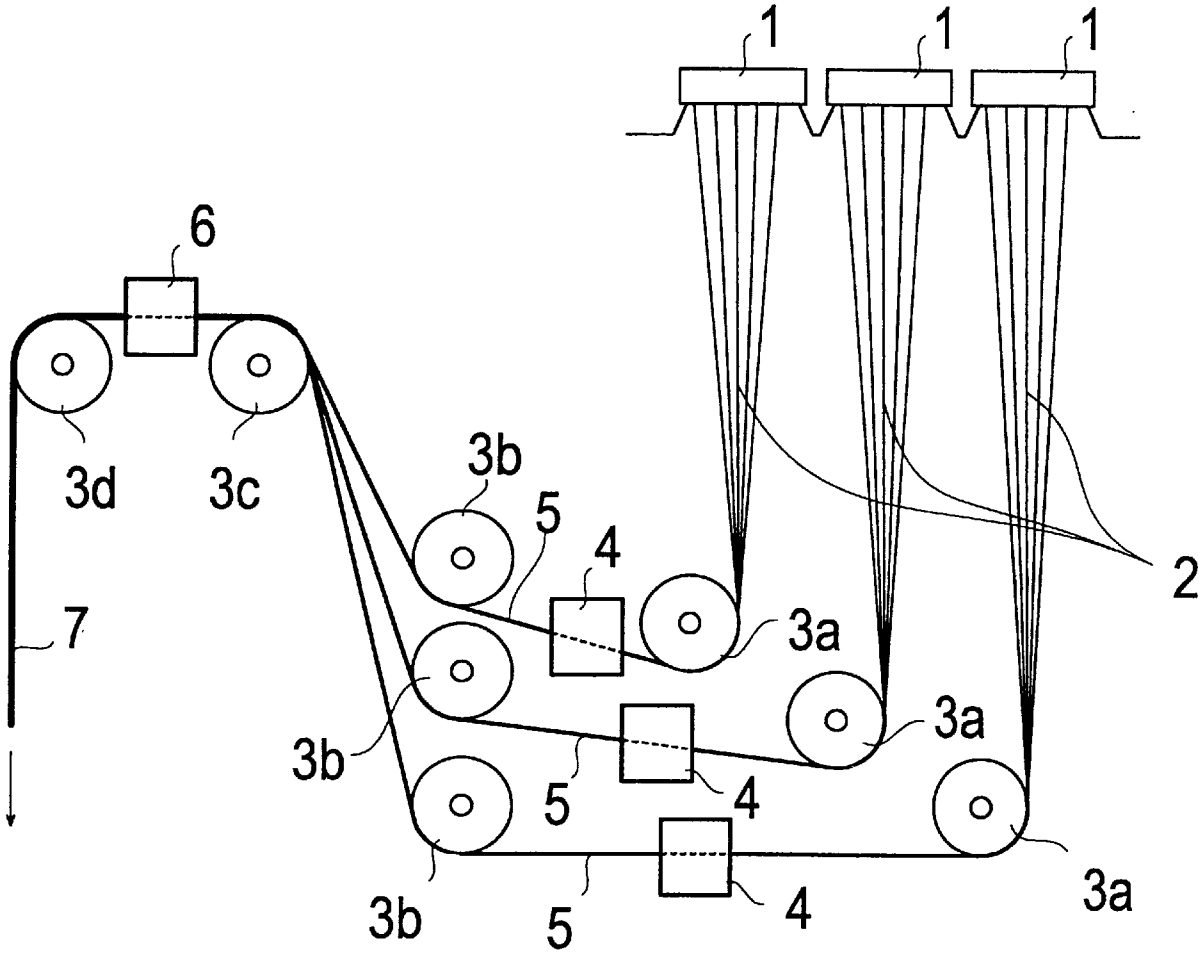
FIG. 1 is a schematic structural diagram illustrating a device for drawing pitch fibers according to one embodiment of this invention.

The pitch fiber bundle which is one kind of the precursor of carbon fibers contemplated by this invention is a second fiber bundle which is formed with not less than two first pitch fiber bundles possessing a degree of intertwining of not more than 100 mm and is characterized by having the first fiber bundles in the second fiber bundle bound at a degree of intertwining in the range of 100 mm–5000 mm.

The pitch type carbon fiber bundle of this invention is a second fiber bundle which is formed with not less than two first carbon fiber bundles possessing a degree of intertwining of not more than 200 mm and is characterized by having the first fiber bundles bound therein at a degree of intertwining of not less than 200 mm and enabling itself to be divided into the first fiber bundles. Further, the pitch type carbon fiber bundle of this invention may be characterized by being a first fiber bundle which results from dividing the second carbon fiber bundle mentioned above.

The method of this invention for the production of a pitch type carbon fibers by an operation of drawing pitch fibers is characterized by the steps of dividing a plurality of pitch fibers into not less than two fiber bundles, then imparting an intertwining action to the fiber bundles with a current of air thereby forming first fiber bundles, binding a plurality of first fiber bundles together, again imparting an intertwining action to the bound pitch fiber bundles with a current of air, and drawing bound pitch fibers as a second fiber bundle.

The pitch type carbon fibers of this invention and the precursor thereof have the characteristic properties and the constructions thereof successively varied along the course of the process of production. The fiber bundle which is formed by the spinning step and the subsequent intertwining treatment is used as a pitch fiber bundle. Similarly thereafter, the fiber bundle which is obtained by the infusibilizing step is used as an infusibilized fiber bundle. The fiber bundle which is subsequently obtained by the low-temperature carbonizing step is used as a low-temperature carbonized fiber bundle or a primary carbonized fiber bundle. Further, the fiber bundle which is obtained by the carbonizing (secondary carbonizing) step is used as a carbonized fiber bundle. The fiber bundle which is obtained thereafter by the graphitizing step which is performed as occasion demands is used as a graphitized fiber bundle. The term "pitch type carbon fiber bundle (otherwise simply called "carbon fiber bundle," "pitch type carbon fibers," or "carbon fibers") refers to either the carbonized fiber bundle and/or the graphitized fiber bundle mentioned above. Then, with respect to the construction of the wording in the present specification (inclusive of the claims), the simple terms "fiber bundle," "first fiber bundle," and "second fiber bundle" as used herein are brief forms of the designations of their points of occurrence in the process of production which are easily inferred distinctly from the context of the relevant preceding and following sentences. Naturally, they are not identical. Specifically, in the case of the fiber bundles which are obtained at the spinning step and in the subsequent intertwining treatment, for example, while they ought to be designated as "pitch fiber bundle," "first pitch fiber bundle," and "second pitch fiber bundle," they are briefly expressed as "fiber bundle," "first fiber bundle," and "second fiber bundle" respectively. By the same token, in the case of fiber bundles which are obtained at the carbonizing step, for example, while they ought to be designated as "carbonized fiber bundle," "first carbonized fiber bundle," and "second carbonized fiber bundle" (or "carbon fiber bundle," "first carbon fiber bundle," and "second carbon fiber bundle" as mentioned above), they are briefly expressed as "fiber bundle," "first fiber bundle," and "second fiber bundle" respectively.

Now, the contents of this invention will be described in detail below with reference to the drawings annexed hereto.

For the production of pitch fibers, the well-known spinning methods have been adopted heretofore. In drawing pitch fibers from a spinning device having disposed therein one or a plurality of spinnerets (spinning nozzles) 1 provided with a plurality of capillaries, pitch fiber filaments 2 enough to produce a prescribed number of fibers are bundled through the medium of pitch fiber take-up rolls 3*a* and divided into not less than two pitch fiber bundles as illustrated in FIG. 1. To the pitch fiber bundles, a bundling agent is imparted as occasion demands. Then, at fiber intertwining devices 4, the fiber bundles are caused to intertwine mutually by means of the current of air to give rise to first fiber bundles (pitch fiber bundles) 5. Then, the bundling agent is imparted to the first fiber bundles 5 either singly or simultaneously, as occasion demands. The first fiber bundles 5 as bound into groups, each of a plurality of bundles, through the medium of rolls 3*b* and 3*c* are caused to intertwine mutually by means of the current of air at a fiber intertwining device 6 and the pitch fibers are taken up as second fiber bundle (pitch fiber bundle) 7 through the medium of a roll 3*d*.

As concrete examples of the raw material for the spinning pitch, coal type pitches such as coal tar and coal tar pitch, coal-liquefied pitch, and ethylene tar pitch, petroleum type pitches such as the decant oil pitch which is obtained from the oil remaining after decomposition with a fluid contact catalyst, and synthetic pitch produced as from naphthalene by the use of a catalyst may be cited. As the pitch which fits the spinning pitch, any of the aforementioned pitches maybe adopted after being modified by the well-known method. Properly, the spinning pitch has a softening point in the range of 200–400° C., preferably in the range of 230–350° C.

The pitch adopted for the spinning is required to be deprived of extraneous substances with a filter having an absolute filtration accuracy of not more than 3 $\mu$m or by a method of filtration capable of acquiring filtration accuracy equal to or higher than that of the filter. If the pitch contains solid extraneous particles measuring not less than 3 $\mu$m, the produced fibers incur frequent breakage.

The conditions for spinning the spinning pitch through the spinnerets (spinning nozzles) include maintaining the spinning temperature at a level at which the pitch manifests a spinning viscosity in the range of 1–300 Pa·s, preferably in the range of 10–200 Pa·s, and more preferably in the range of 20–100 Pa·s, using capillaries of a diameter in the range of 0.05–0.5 mm, preferably in the range of 0.08–0.3 mm, and drawing and stretching fibers at a spinning speed (take-up speed) in the range of 10–2000 m/min, preferably in the range of 100–1000 m/min, and more preferably in the range of 200–600 m/min. If the spinning viscosity is less than 1 Pa·s, the shortage will be a disadvantage because it will result in a deficiency in spinnability due to unduly low viscosity. If the spinning viscosity exceeds 300 Pa·s, the excess will be a disadvantage because it will result in the spun fibers to manifest unduly large tension and consequently tend to sustain breakage. If the diameter of the capillaries is less than 0.05 mm, the shortage will be a disadvantage because it will result in the capillaries readily clogging. If this diameter exceeds 0.5 mm, the excess will be a disadvantage because it will result in the fibers having varying diameter. If the spinning speed is less than 10 m/min, the shortage will be a disadvantage because it will result in conspicuously degrading productivity. If the spinning speed exceeds 2000 m/min, the excess will be a disadvantage because it will result in imparting an unduly large tension to the spun fibers owing the resistance of air.

The spinning device which can be used in this case has disposed therein one or a plurality of spinnerets (spinning nozzles) each provided with a plurality of capillaries. The number of spinning nozzles to be disposed in this case is preferred to be not more than 10. If this number exceeds 10, the excess will complicate coordinate adjustment among the nozzles, compel the intervals between the adjacent spinning nozzles to widen so much as to prevent required elongation from being easily attained with a single roll difficult, and render production of uniform multifilament carbon fibers difficult. Properly, the number of capillaries is in the range of 100–10000, preferably 500–5000, and more preferably 1000–3000, per spinning nozzle. The spinning device provided with these spinning nozzles does not need to be particularly discriminated. Any of the spinning devices heretofore known to the art maybe suitably adopted. The spinning device which is described and illustrated in U.S. Pat. No. 5,425,931 may be cited as one concrete example.

The number of filaments in each of not less than two pitch fiber bundles divided by the spinning is generally in the range of 100–10000, preferably 500–5000, and more preferably 1000–3000. If the number of filaments is less than 100, the shortage will be a disadvantage because it will result in compelling the fiber bundles to suffer from deterioration in handling property. Conversely, if the number of filaments exceeds 10000, the excess will be a disadvantage because it will result in preventing the produced carbon fibers from deserving the designation of "small size" as aimed at by this invention.

Since the pitch fibers have their diameter shrink as they are infusibilized, carbonized, and graphitized, it is proper to fix the diameter of the pitch fiber filaments in consideration of this shrinkage. The diameter of the pitch fiber filaments is generally in the range of 5–30 $\mu$m, preferably in the range of 7–20 $\mu$m, and more preferably in the range of 8–15 $\mu$m. If the diameter of the pitch fiber filaments is less than 5 $\mu$m, the shortage will be a disadvantage because it will result in rendering the spinning unusually difficult. Conversely, if the diameter exceeds 30 $\mu$m, the excess will be a disadvantage because it will result in causing the fibers to be deficient in handling property.

Figure 2A:
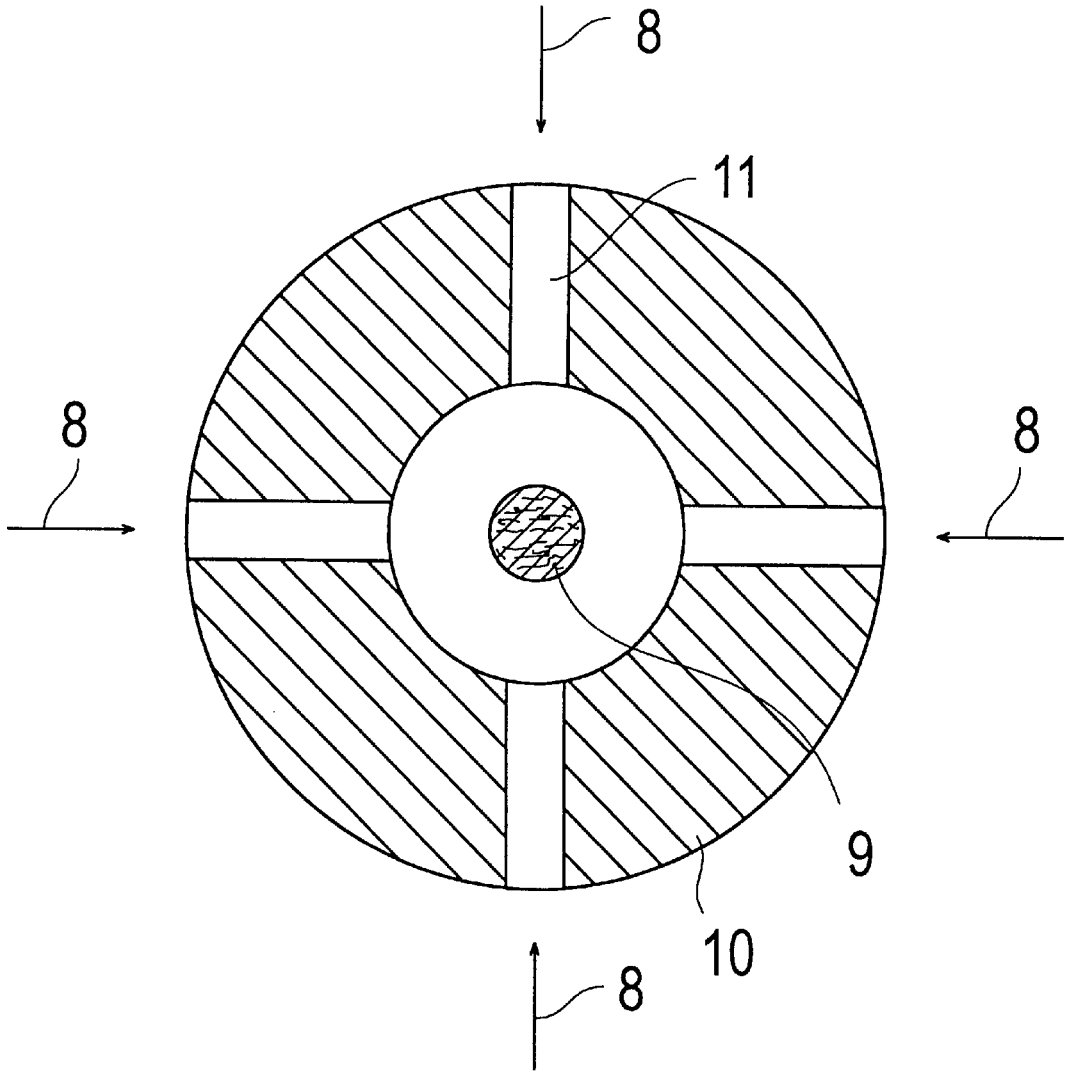
FIGS. 2(A) to (C) are schematic structural diagrams (cross section) illustrating a device for intertwining fibers by means of a current of air according to one embodiment of this invention.
Figure 2B:
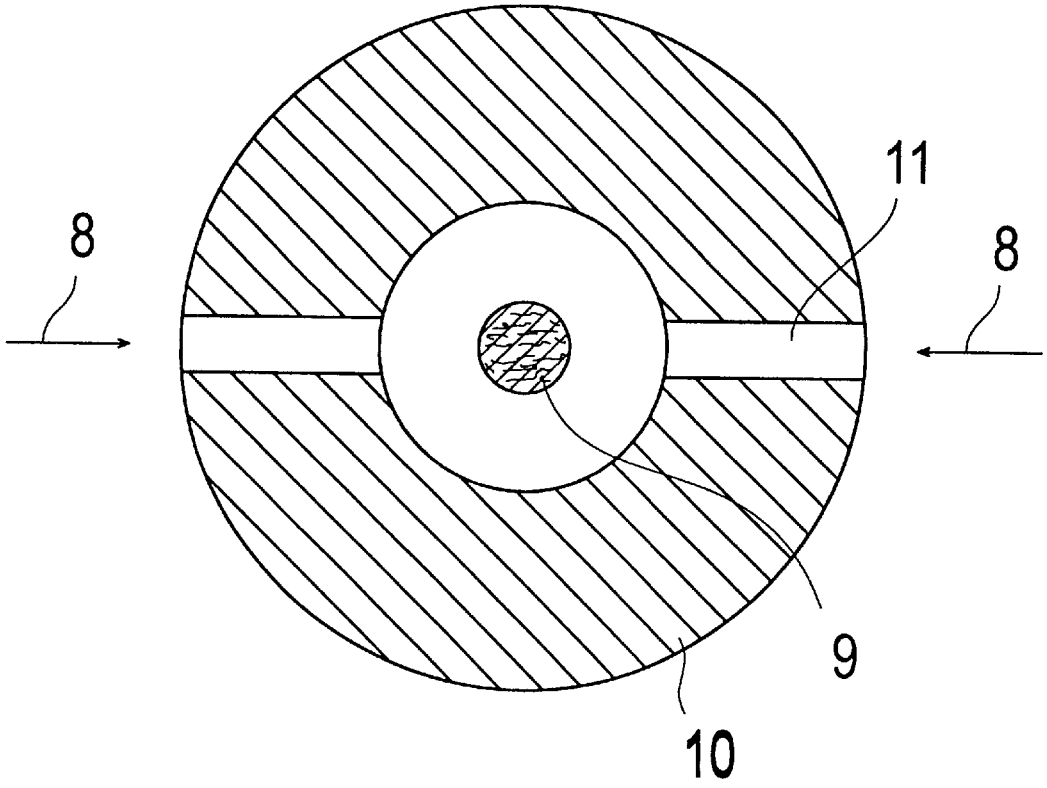
Figure 2C:
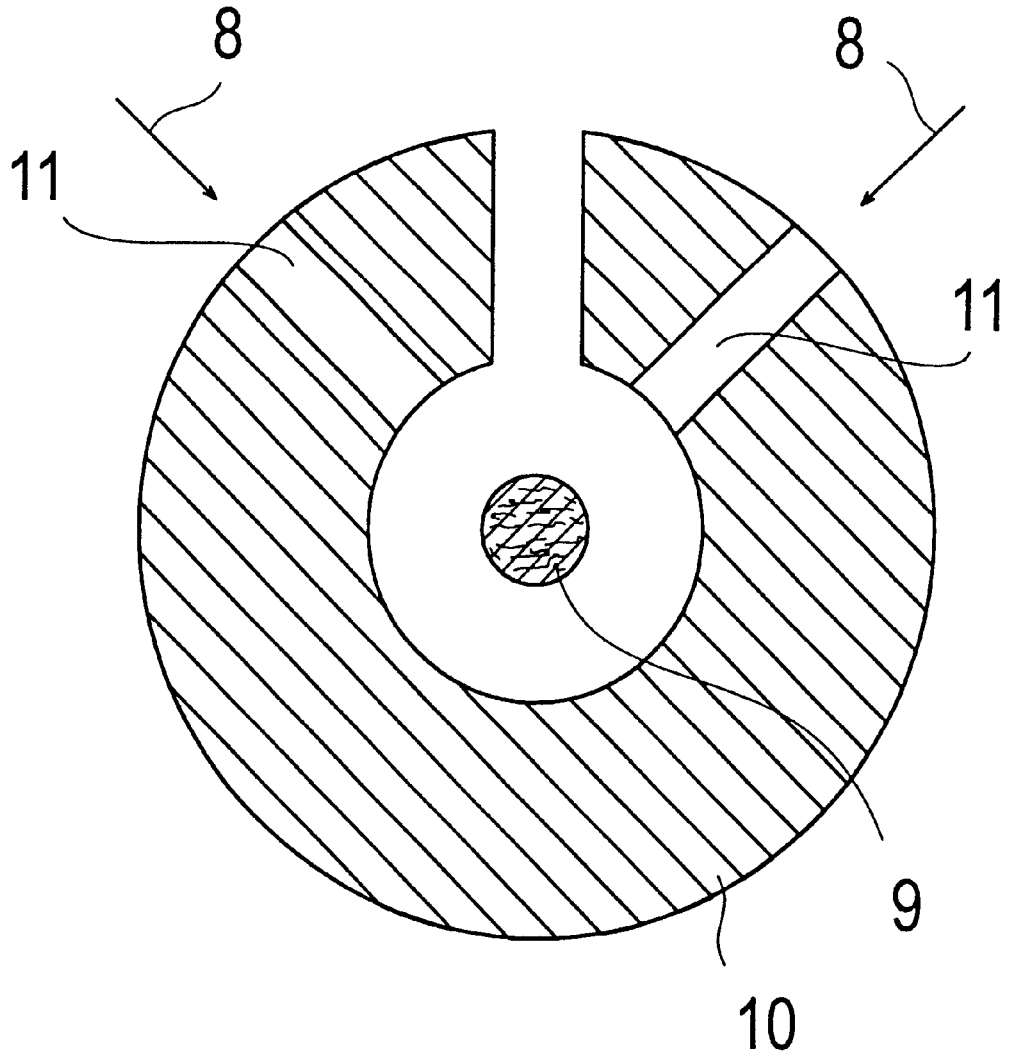

To obtain the first fiber bundles mentioned above, impartation of a current of air at a rate in the range of 1–50 m/s, preferably 1.5–20 m/s, and more preferably 2–10 m/s, to the fiber bundles from two or more directions suffices. Consequently, the pitch fiber bundles can be given light intertwining. If the current of air has a speed of less than 1 m/s, the shortage will be a disadvantage because it will result in inducing only insufficient intertwining and causing the division of fibers at a later step to incur difficulty. Conversely, if this speed exceeds 50 m/s, the excess will be a disadvantage because it will result in compelling the pitch fibers to raise fluff, causing the intertwining to proceed to an unduly large extent, and degrading the carbon fibers in quality. Specifically, for the purpose of obtaining the first fiber bundles 5 as illustrated in FIG. 1, it suffices to impart intertwining to the pitch fiber bundles with the current of air in the fiber intertwining devices 4. To be more specific, it suffices to exert currents of air 8 at the speed mentioned above in two or more directions through two or more air inlets 11 formed in a cylindrical fiber intertwining device proper 10 on a fiber bundle 9 passing the internal path of the fiber intertwining device proper 10 as illustrated in FIGS. 2(A) to (C). The total volume of the current of air introduced through the air inlets in this case is generally in the range of 0.01–20 $m^3$/hr, preferably in the range of 0.02–5 $m^3$/hr, and more preferably in the range of 0.05–1 $m^3$/hr. If the total volume of the current of air is less than 0.01 $m^3$/hr, the shortage will be a disadvantage because it will result in rendering the intertwining insufficient. Conversely, if this total volume exceeds 20 $m^3$/hr, the excess will beat a disadvantage because it will result in the intertwining proceeding to an unduly large extent. The current of air generally may be kept at normal room temperature. The current of air may be suitably cooled or heated for the purpose of adjusting the degree of intertwining. The number of air inlets and the diameter thereof may be decided to obtain the flow speed and the total volume of currents of air mentioned above. Further, for the purpose of effectively introducing currents of air 8 from two or more directions, two or more air inlets 11 may be disposed on the same circumference as the cylindrical fiber intertwining device proper 10 (FIGS. 2(A) to (C)). Otherwise, two or more air inlets 11 may be disposed as suitably separated in the axial direction of the cylindrical fiber intertwining device proper. Optionally, the air inlets disposed in the two modes mentioned above may be formed in combination in one cylindrical fiber intertwining device proper 10. The current of air 8 may be blown against the fiber bundle 9 at any angle in the range of 0°–180° relative to the direction of advance of the fiber bundle as (1) substantially perpendicular to the direction of advance of the fiber bundle 9 (FIGS. 2(A) to (C)), (2) in a direction opposite the direction of advance of the fiber bundle, or (3) in a direction conforming to the direction of advance of the fiber bundle. Though this angle does not need to be particularly discriminated, it is proper in the range of 45°–135°, and preferably in the range of 60°–120°. The inside diameter of the cylindrical fiber intertwining device proper mentioned above is only required to be large enough for imparting the required intertwining sufficiently to the fibers. The inside diameters generally falls in the range of 2–30 mm. Not less than two air blow nozzles may be independently disposed so as to provide currents of air to the fiber bundle from two or more directions instead of using the cylindrical fiber intertwining device proper. The manner of providing such currents of air does not need to be particularly discriminated.

The degree of intertwining of the first pitch fiber bundles is properly not more than 100 mm, preferably in the range of 10 mm–100 mm, and more preferably in the range of 20 mm–100 mm. If the degree of intertwining exceeds 100 mm, the excess will be a disadvantage because it will result in impairing the divisibility of the second fiber bundles into the first fiber bundles. Incidentally, the lower limit of the degree of intertwining of the first pitch fiber bundles is desirably set at 10 mm from the viewpoint of the opening properties (expansibility) of fiber bundles.

The bundling agent which is imparted, as occasion demands, to the first fiber bundles, taken either singly or simultaneously, does not need to be particularly discriminated. Any of the bundling agents heretofore known to the art may be suitably utilized. As concrete examples of the bundling agent, water, silicone, organic solvents, and aqueous emulsions of silicone and organic solvents may be cited.

For the purpose of obtaining the second fiber bundles, it suffices to provide currents of air at a speed properly in the range of 10 m/s–400 m/s, preferably in the range of 15–300 m/s, and more preferably in the range of 20–200 m/s, from at least two directions to the fiber bundle formed by bonding a plurality of first fiber bundles. Consequently, light intertwining can be provided to the whole pitch fiber bundle. If the speed of the currents of air is less than 10 m/s, the shortage will be a disadvantage because it will result in the second fiber bundle separating easily into the first fiber bundles and rendering the handling at the subsequent step difficult. If this speed exceeds 400 m/s, the excess will cause the pitch fibers to raise fluff and render division into the first fiber bundles difficult. Specifically, for the purpose of obtaining a second fiber bundle 7, it suffices to impart necessary intertwining to a fiber bundle formed by binding a plurality of first fiber bundles with currents of air at a prescribed speed at the fiber intertwining device 6 as illustrated in FIG. 1. More specifically, it suffices to impart currents of air 8 at the speed mentioned above from two or more directions through not less than two air inlets 11 disposed in the cylindrical fiber intertwining device proper 10 to the fiber bundle 9 passing the internal path of the cylindrical fiber intertwining device proper 10 as illustrated in FIGS. 2(A) to (C). The flow volume of currents of air which are given through the air inlet in this case is generally in the range of 0.1–200 $m^3$/hr, preferably in the range of 0.2–50 $m^3$/hr, and more preferably in the range of 0.4–30 $m^3$/hr. If the flow volume of the currents of air mentioned above is less than 0.1 $m^3$/hr, the shortage will be a disadvantage because it will result in the second fiber bundle being easily divided into the first fiber bundles and rendering the handling of fiber bundles at a later step difficult. If the flow volume of the currents of air mentioned above exceeds 200 $m^3$/hr, the excess will be a disadvantage because it will possibly result in the pitch fibers being to raise fluff. The currents of air mentioned above are generally maintained at normal room temperature. Optionally, they may be suitably cooled or heated for the purpose of adjusting the degree of intertwining. The number of air inlets and the diameter thereof may be decided to obtain the flow speed and the total volume of currents of air mentioned above. Further, for the purpose of effectively introducing currents of air 8 from two or more directions, two or more air inlets 11 may be disposed on the same circumference as the cylindrical fiber intertwining device proper 10 (FIGS. 2(A)to (C)). Otherwise, two or more air inlets 11 may be disposed as suitably separated in the axial direction of the cylindrical fiber intertwining device proper. Optionally, the air inlets disposed in the two modes mentioned above may be formed in combination in one cylindrical fiber intertwining device proper 10. The current of air 8 may be blown against the fiber bundle 9 at any angle in the range of 0°–180° relative to the direction of advance of the fiber bundle as (1) substantially perpendicular to the direction of advance of the fiber bundle 9 (FIGS. 2(A) to (C)), (2) in a direction opposite the direction of advance of the fiber bundle, or (3) in a direction conforming to the direction of advance of the fiber bundle. Though this angle does not need to be particularly discriminated, it is proper in the range of 45°–135°, preferably in the range of 60°–120°. The inside diameter of the cylindrical fiber intertwining device proper mentioned above is only required to be large enough for imparting required intertwining sufficiently to the fibers. The inside diameter generally falls in the range of 5–100 mm. Not less than two air blow nozzles may be independently disposed so as to give currents of air to the fiber bundle from two or more directions instead of using the cylindrical fiber intertwining device proper. The manner of giving such currents of air does not need to be particularly discriminated.

The degree of intertwining among the first pitch fiber bundles forming the second fiber bundle is properly not less than 100 mm, preferably in the range of 100 mm–5000 mm, and more preferably in the range of 200 mm–4000 mm. If the degree of intertwining is less than 100 mm, the shortage will be at a disadvantage in impairing the divisibility of the second fiber bundles into the first fiber bundles. Incidentally, though the upper limit of the degree of intertwining among the first fiber bundles does not need to be particularly discriminated, it is preferred to be set at 5000 mm from the viewpoint of the ease of handling of the second fiber bundle. Further, the degree of intertwining the first fiber bundles in the second fiber bundle is equal to the degree of intertwining of each of the first fiber bundles mentioned above.

Properly, the number of the first fiber bundles which form the second fiber bundle is not less than 2, preferably in the range of 2–20, and more preferably 2–10. The upper limit of the number of first fiber bundles is preferred to be set at 20 from the viewpoint of the ease of division of the second fiber bundle into the first fiber bundles. Properly, the total number of filaments in the second fiber bundle, therefore, is in the range of 200–200,000, preferably in the range of 1000–100,000, and more preferably in the range of 2000–30,000. If the total number of filaments of the second fiber bundle is less than 200, the shortage will be a disadvantage because it will result in lowering productivity and impairing the handling property. Conversely, if the total number of filaments of the second fiber bundle exceeds 200,000, the excess will be a disadvantage because it will result in allowing the second fiber bundle wholly to undergo a uniform reaction at the infusibilizing step only with difficulty.

The pitch fiber bundle which is obtained as described above as one kind of the precursor of carbon fibers (namely the second pitch fiber bundle formed of a plurality of first pitch fiber bundles) is a second fiber bundle which is formed of not less than two first pitch fiber bundles possessing a degree of intertwining of not more than 100 mm as described above and is characterized by the fact that the degree of intertwining among the first fiber bundles in the second fiber bundle is in the range of 100 mm–5000 mm.

The second pitch fiber bundle which has been drawn out may be reeled up temporarily on a bobbin or may be directly rocked in a yarn case or a can. It may be otherwise rocked on a conveyer and then delivered directly to a later step such as the infusibilizing step.

The second pitch fiber bundle which is formed of a plurality of first pitch fiber bundles as described above may be handled in the same conventional manner as the ordinary pitch fiber bundle and infusibilized and carbonized in accordance with the conventional technique. Now the infusibilization and the carbonization will be briefly described below.

First, the second pitch fiber bundle which has been drawn out and (1) reeled up on the bobbin, (2) contained in the can, or (3) rocked onto the conveyer in a shakable state is subjected to infusibilization in the atmosphere of an oxidizing gas at a temperature in the range of 100–400° C., preferably 100–350° C., for a period in the range of 10–1000 minutes, preferably 30–500 minutes. If the temperature is less than 100° C., the shortage will be a disadvantage because it will result in retarding the reaction of infusibilization. If the temperature exceeds 400° C., the excess will be likewise at a disadvantage in promoting oxidation excessively. If the infusibilizing time is less than 10 minutes, the shortage will be a disadvantage because it will result in allowing the reaction of infusibilization to proceed only insufficiently. If the infusibilizing time exceeds 1000 minutes, the excess will be a disadvantage because it will result in lowering the productivity.

As the oxidizing gas mentioned above, a gas which has a nitrogen dioxide concentration in the range of 0–10 vol. %, preferably 0.5–5 vol. % and an oxygen concentration in the range of 1–50 vol. %, preferably 5–30 vol. %, for example, may be used.

Then, the infusibilized fibers which have been obtained by this infusibilization are treated for initial carbonization (primary carbonization or low-temperature carbonization) in the atmosphere of an inert gas at a temperature in the range of 300–800° C. for a period in the range of 1–200 minutes, preferably 10–60 minutes. Consequently, the second fiber bundle resulting from the initial carbonization can retain the state of one fiber bundle without being separated into the first fiber bundles. It, therefore, can be handled in the same manner as a usually produced fiber bundle.

Subsequently, the second fiber bundle which has undergone this low-temperature carbonization is delivered into a furnace packed with the atmosphere of such an inert gas as nitrogen gas or argon gas and kept at a temperature in the range of 600–1500° C., preferably 600–1200° C., and simultaneously fired therein for carbonization (secondary carbonization) for a period in the range of 10 seconds–30 minutes, preferably 20 seconds–5 minutes. If the temperature of carbonization (secondary carbonization) used in this case is lower than 600° C., the shortage of temperature will be a disadvantage because it will result in compelling the second carbonized fiber bundle to acquire unduly low strength and allow no easy handling at the subsequent graphitizing step. Conversely, if the temperature exceeds 1500° C., the excess will be a disadvantage because it will result in the second carbonized fiber bundle to acquire an unduly large modulus of elasticity and, when the second carbonized fiber bundle is wound on a bobbin, pose the problem of raising fluff, for example. If the period of carbonization (second carbonization) is less than 10 seconds, the shortage will be a disadvantage because it will result in not allowing the carbonization to proceed sufficiently. Conversely, if this period exceeds 30 minutes, the excess will be a disadvantage because it will result in bringing serious impairment of the productivity.

By obtaining the second carbonized fiber bundle under the conditions of production which are set as described above, it is made possible to improve veritably the productivity during the course of the subsequent graphitizing step. Since the pitch type carbon fibers are produced by using feeble pitch fibers as the starting material, the second carbonized fiber bundle inevitably sustains such defects as, for example, mutual fusion of adjacent fibers or rigidification thereof. For the second carbonized fiber bundle, abolition of partial injury or partial rupture is extremely difficult to achieve. Thus, the practice of subjecting the second carbonized fiber bundle, before the second carbonized fiber bundle is stowed in a container such as a can or wound on a bobbin, to examination by visual inspection or with the aid of an optical detector to detect points of partial defect thereon and compulsorily cutting the second carbonized fiber bundle at the detected points and removing the portions in trouble from the fiber bundle is highly recommended. By this practice, it is made possible to supply the second carbonized fiber bundle containing no defect at all to the subsequent graphitizing step and improve further the productivity of the graphitizing step. As a result, the practice brings the advantage of enabling the carbon fiber products to be manufactured with a prominently improved operational efficiency.

Figure 3:
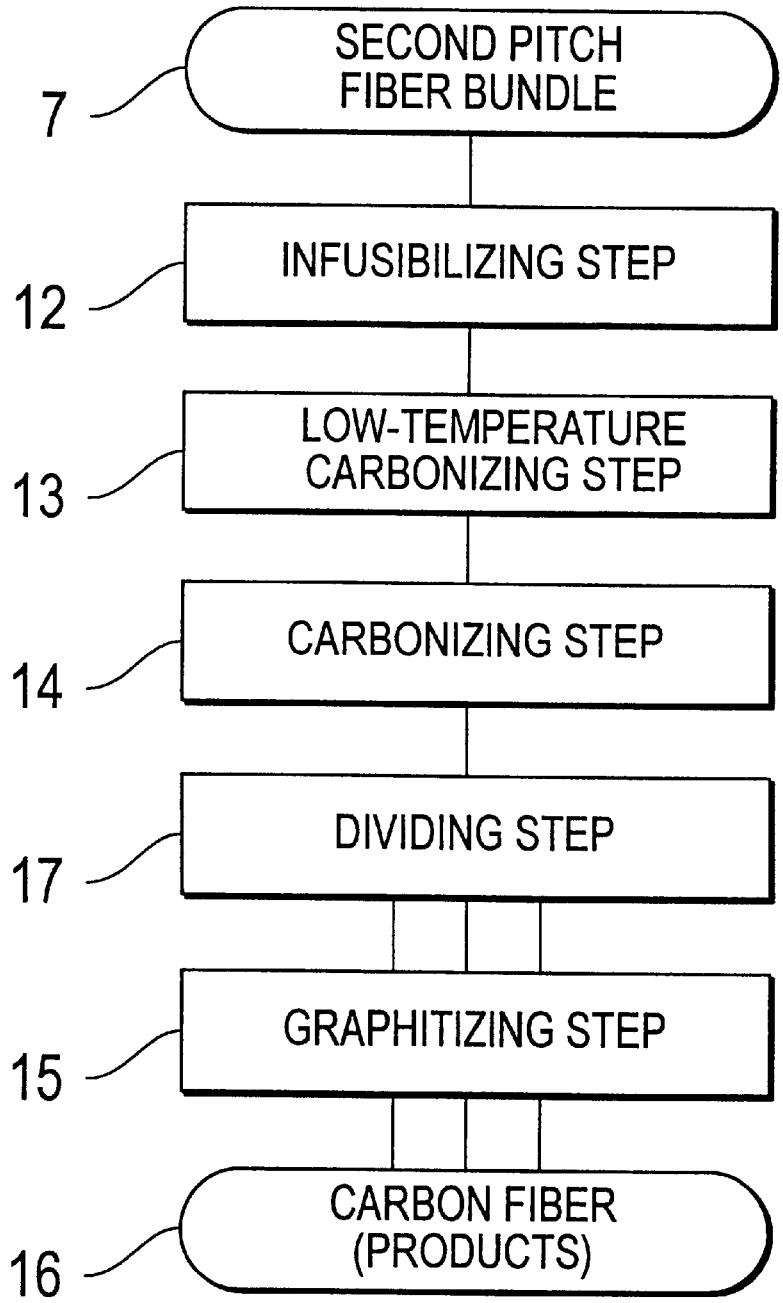
FIG. 3 is a schematic structural diagram illustrating a process for the production of carbon fibers (division after carbonization) according to one embodiment of this invention.
Figure 4:
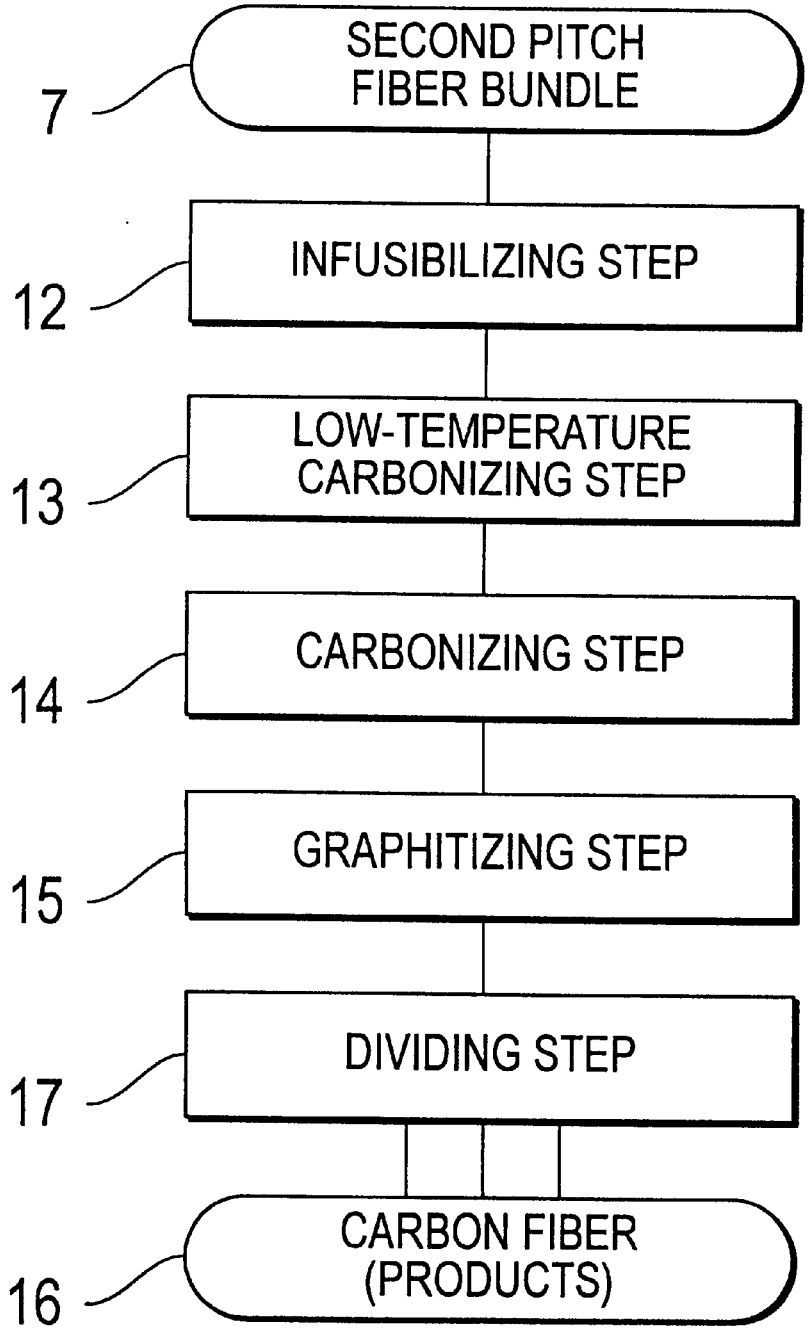
FIG. 4 is a schematic structural diagram illustrating a process for the production of carbon fibers (division after graphitization) according to one embodiment of this invention.

Since the carbonization imparts exalted strength to the fibers and facilitates the handling of the fibers, the second carbonized fiber bundle consequently produced may be divided into a plurality of first carbonized fiber bundles to afford carbonized fibers of a small size. Then, by graphitizing the carbonized fibers formed of such first fiber bundles, it is made possible to produce carbon fibers of a low size. The flow of the process involved herein is illustrated roughly in FIG. 3. Specifically, the second pitch fiber bundle 7, sequentially as described above, may be infusibilized at an infusibilizing step 12 and carbonized at a low-temperature carbonizing step 13 and a carbonizing step 14 to obtain a second carbonized fiber bundle. Thereafter, this fiber bundle may be divided into first carbonized fiber bundles at a dividing step 17 and further graphitized at a graphitizing step 15 to manufacture carbon fibers 16 of a low size. Otherwise, as illustrated in FIG. 4, the second pitch fiber bundle 7, sequentially as described above, may be infusibilized at the infusibilizing step 12, carbonized at a low-temperature carbonizing step 13 and a carbonizing step 14, and further graphitized at the graphitizing step 15 to obtain the second carbon fiber bundle. Thereafter, this fiber bundle may be divided at the dividing step 17 into first fiber bundles to efficiently produce carbon fibers 16 of a low size. In the method of this invention for producing carbon fibers, though the graphitizing step is not necessarily an essential component of process, it is preferred to be carried out.

For the purpose of enabling the second fiber bundle resulting from carbonization or graphitization to be easily divided into first fiber bundles and relieving the first fiber bundles of intertwined single fibers, the second fiber bundle in the process of carbonization is preferred to be linearly fired while exposed meanwhile to a tension in the range of 0.29 mN/tex–9.8 mN/tex, preferably 0.50–5.0 mN/tex. If the tension during the carbonization is less than 0.29 mN/tex, the effect of the tension in improving the division and lowering the intertwining will not be sufficient. Conversely, if the tension during the carbonization exceeds 9.8 mN/tex, the excess will be a disadvantage because it will result in inducing rupture of fibers during the course of carbonization. Further, by simultaneously carrying out the firing and the exertion of the tension mentioned above during the carbonization (second carbonization) performed under the temperature conditions mentioned above, it is made possible for the first time to uniformize the shrinkage of fibers in the direction of length which is induced at a carbonizing temperature of not less than 400° C. and consequently, obtain a second fiber bundle with improved alignment of fibers.

The production of a plurality of first fiber bundles by the division of the second fiber bundle may be attained by dividing the second fiber bundle into the first fiber bundles by the use of a pin or a guide subsequent to carbonization or graphitization or by the use of a plurality of yarn guide pulleys. Such implements as pins, guides, or pulleys which are used in dividing a fiber bundle are preferred to generate as small an amount of friction with fibers as possible and raise as slight an amount of fluff as permissible. They are not particularly discriminated on account of factors such as material and shape.

Then, (a) the second carbonized fiber bundle resulting from carbonization (second carbonization), (b) the second carbonized fiber bundle in the process of being divided into first carbonized fiber bundles, or (c) the first carbonized fiber bundles produced by division of the second fiber bundle subsequent to carbonization is paid out into a furnace packed with the atmosphere of an inert gas and kept at a temperature higher than the carbonizing (second carbonizing) temperature, preferably a temperature in the range of 1500–3000° C., and fired therein for a period in the range of 1 second–30 minutes, preferably 10 seconds–10 minutes, to effect graphitization.

The fiber bundle identified in any of the items (a), (b), and (c) mentioned above is preferred to be graphitized while simultaneously exposed to a tension in the range of 0.29–100 mN/tex.

The second fiber bundle (carbonized fiber bundle or graphitized fiber bundle) which is obtained without being divided into first fiber bundles at the carbonizing step or graphitizing step mentioned above has a degree of intertwining within the first fiber bundle of not more than 200 mm, preferably in the range of 10 mm–200 mm, and more preferably 20 mm–200 mm. If the degree of intertwining exceeds 200 mm, the excess will be a disadvantage because it will result in impairing the divisibility into the first fiber bundles. The degree of intertwining between the adjacent first fiber bundles is not less than 200 mm, preferably not less than 500 mm, and more preferably not less than 1000 mm. If the degree of intertwining between the adjacent first fiber bundles is less than 200 mm, the shortage will be a disadvantage because it will result in impairing the divisibility of the second fiber bundle into the first fiber bundles. Though the second carbon fiber bundle is generally handled as fibers of a relatively large size, it may be divided, when necessary, into the first fiber bundles. When it is used as divided, meanwhile, into the first fiber bundles during the production of a woven fabric or a prepreg, it proves proper for producing light weight woven fabrics or prepregs.

The pitch type carbon fiber bundle contemplated by this invention is a second fiber bundle which is formed of not less than two first carbon fiber bundles having a degree of intertwining of not more than 200 mm and is characterized by having the first fiber bundles bound therein with a degree of intertwining of not less than 200 mm and posessing an ability to be divided into first fiber bundles. Further, the pitch type carbon fiber bundle of this invention may be characterized by being a first fiber bundle formed by the division of the second carbon fiber bundle mentioned above. Since the pitch type carbon fiber bundle of this invention can be obtained in the form of carbon fibers of a low size which neither raises fluff nor suffers from dispersion of size, it fits for the production of a light-weight woven fabric or prepreg of carbon fibers and proves useful in various industrial fields covering sports, leisure events, and aerospace technology.

Needless to mention, the pitch type carbon fiber bundle of this invention, like the existing carbon fibers, possess various properties such as high strength and high modulus of elasticity in addition to those mentioned above. Specifically, the filament which forms the fiber bundle possesses tensile strength of not less than 0.5 GPa, preferably in the range of 1–7 GPa, and modulus of tensile elasticity of not less than 30 GPa, preferably in the range of 50–1000 GPa. The number of filaments in the pitch type carbon fiber bundle of this invention may be properly decided to suit the purpose for which the fiber bundle is used. In the case of the second carbon fiber bundle, this number is generally in the range of 200–200,000, preferably in the range of 1000–100,000, and more preferably 2000–30,000. The average diameter of the filaments forming the pitch type carbon fiber bundle may be properly decided to suit the purpose for which the fiber bundle is used. It is generally in the range of 4–25 $\mu$m, preferably in the range of 5–15 $\mu$m, and more preferably 6–12 $\mu$m.

Now, the present invention will be described below with reference to working examples and controls with a view to further clarifying it.

The degree of intertwining mentioned herein has been rated (by the hook drop method) as follows.

A given fiber bundle was vertically suspended as stretched with a varying tension in the range of 0.12 mN/tex–0.16 mN/tex. Through the medium of a wire measuring 0.8 mm in diameter and having a leading edge, about 2 cm in length, bent at a right angle, a weight of 1.2 g in the case of a pitch fiber bundle or a weight of 0.2 g in the case of a carbon fiber bundle was hooked on a given fiber bundle and allowed to fall down spontaneously. The length of this fall was measured and reported as the degree of intertwining. In this invention, ten measurements were made per condition and the average of the numerical values consequently obtained was used for the report. In the case of a carbon fiber bundle which was given a sizing treatment, the sample thereof was fired in the air at 450° C. for one hour to be deprived of the sizing agent adhering thereto before it was put to the measurement.

EXAMPLE 1

Coal tar pitch deprived of quinoline insolubles and possessing a softening point of 80° C. was directly hydrogenated by the use of a catalyst. The hydrogenated pitch was heat-treated under normal pressure at 480° C. and then deprived of low boiling components to afford mesophase pitch. This pitch was found to have a softening point of 300° C. and a mesophase content of 95 wt. %. This pitch was passed through a filter at a temperature of 340° C. to remove extraneous substances and afford purified pitch. This purified pitch as the raw material for spinning was subjected to spinning by the use of three spinnerets containing 1000 capillaries.

The fibers drawn through each of the nozzles at a spinning viscosity of 60 Pa·s and a spinning speed of 400 n/min were bound into three bundles each of 1000 filaments. The fiber bundles were given a silicone type bundling agent and were caused to intertwine with currents of air blown at a speed of 4 m/s from two directions to afford three first pitch fiber bundles. The three first fiber bundles were bound and exposed to currents of air blown at a speed of 50 m/s from eight directions to give rise to a second fiber bundle. This fiber bundle was stowed in a can. The second fiber bundle was found to have an average fiber diameter of 9.8 $\mu$m and comprise 3000 filaments. In the second fiber bundle, the degree of intertwining within the first fiber bundles was 45 mm and the degree of intertwining between the adjacent first fiber bundles foaming the second fiber bundle was 1500 mm.

Then, the second pitch fiber bundle as stowed in the can was placed in the atmosphere of air having 5 vol. % of nitrogen dioxide gas incorporated in advance therein, heated therein from 150° C. to 300° C. at a temperature increasing rate of 1° C./min by blowing an oxidizing gas into the atmosphere through the lower part of the can, and retained therein at 300° C. for 30 minutes to afford infusibilized fibers. The infusibilized fibers as stowed in the can were heated in the atmosphere of nitrogen gas to 390° C. at a temperature increasing rate of 10° C./min and retained at this temperature for 30 minutes to effect low-temperature carbonization. The fiber bundle, similarly to the usually produced fiber bundle formed of 3000 filaments, was not divided into three fiber bundles but was retained as one fiber bundle. Then, this fiber bundle was linearly fired at a temperature of 1100° C. as exposed to tension of 1.18 mN/tex, with the fiber threads thereof meanwhile paid out of the can into a furnace packed with the atmosphere of nitrogen gas. The fired fiber bundle was taken up on a bobbin. The carbonized fiber bundle resulting from the process described above and taken up on the bobbin assumed a form such that 1000 fiber bundles could be easily divided into three bundles. In this carbonized fiber bundle, the degree of intertwining within the first fiber bundles was 55 mm and the degree of intertwining between the adjacent first fiber bundles in the second fiber bundle exceeded 5000 mm. The carbonized fiber bundle on the bobbin was rewound and the fiber bundle of 1000 filaments was graphitized at a temperature of 2500° C. as divided into three bundles with a guide to produce three carbon fiber bundles each of 1000 filaments from one carbonized fiber bobbin. This carbon fiber bundle was found to comprise 1000 filaments, possess an average fiber diameter of 7.0 $\mu$m, and manifest a fine appearance free from fluff. The filament which form the carbon fiber bundle was possessed of tensile strength of 4.2 GPa, and modulus of tensile elasticity of 620 GPa.

EXAMPLE 2

A carbon fiber bundle was obtained by graphitizing the carbonized fiber bundle obtained in Example 1 in its undivided state at a temperature of 2700° C. In this fiber bundle, the degree of intertwining within the first fiber bundles remaining after removal of the sizing agent was 70 mm and the degree of intertwining between the adjacent first fiber bundles in the second fiber bundle exceeded 5000 mm. This carbon fiber bundle was divided by the use of a plurality of guide pulleys into three fiber bundles each formed of 1000 filaments and the three fiber bundles were each taken up on a bobbin. The carbon fiber bundle comprising 1000 filaments was found to have an average fiber diameter of 6.9 $\mu$m, and suffer from neither rise of fluff nor dispersion of fiber size. The filament which form the carbon fiber bundle was possessed of tensile strength of 4.1 GPa, and a modulus of tensile elasticity of 800 GPa.

Control 1

The refined pitch of Example 1 was spun by the use of three spinnerets each containing 1000 capillaries. The fibers drawn through the nozzles at a spinning viscosity of 60 Pa·s and a spinning speed of 400 m/min were bound into bundles each of 1000 filaments. The fiber bundles were merely given a silicone type bundling agent and not intertwined by exposure to currents of air. Three first fiber bundles were bound and exposed to currents of air blown at a speed of 50 m/s from eight directions to afford a second fiber bundle. This second fiber bundle was stowed in a can. The degree of intertwining of the pitch fiber bundle could not be measured because this fiber bundle was not divisible into the first fiber bundles. The degree of intertwining in the whole second fiber bundle was found to be 40 mm.

Then, the pitch fiber bundle as stowed in the can was placed in the atmosphere of air having 5 vol. % of nitrogen dioxide gas incorporated in advance therein, heated therein from 150° C. to 300° C. at a temperature increasing rate of 1° C./min by blowing an oxidizing gas into the atmosphere through the lower part of the can, and retained therein at 300° C. for 30 minutes to afford infusibilized fibers. The infusibilized fibers as stowed in the can were heated in the atmosphere of nitrogen gas to 390° C. at a temperature increasing rate of 10° C./min and retained at this temperature for 30 minutes to effect low-temperature carbonization. Then, the fiber bundle was linearly fired at a temperature of 1100° C. as exposed to a tension of 1.18 mN/tex, with the fiber threads paid out of the can into a furnace packed with the atmosphere of nitrogen gas. The fired fiber bundle was taken up on a bobbin. The fiber bundle resulting from this process and taken up on the bobbin was retained to be a fiber bundle of 3000 filaments and was not divided into fiber bundles each of 1000 filaments.

The resultant carbonized fiber bundle was rewound from the bobbin and then subjected to attempted graphitization at a temperature of 2500° C. while compulsorily divided with a guide into three fiber bundles each of 1000 filaments. It could not be continuously divided. The fiber bundle was broken halfway in its entire length. Thus, the carbon fiber bundle of 1000 filaments could not be stably obtained.

Control 2

The refined pitch of Example 1 was spun by the use of three spinnerets each containing 1000 capillaries. The fibers drawn through the nozzles at a spinning viscosity of 60 Pa·s and a spinning speed of 400 m/min were bound into bundles each of 1000 filaments. The fiber bundles were given a silicone type bundling agent and were intertwined by exposure to currents of air blown at a speed of 4 m/s from two directions to afford three first fiber bundles. Three first fiber bundles were bound to afford directly a second fiber bundle unlike those of Example 1. This second fiber bundle was stowed in a can. In this pitch fiber bundle, the degree of intertwining within the first fiber bundles was 50 mm and the degree of intertwining between the adjacent first fiber bundles in the second fiber bundle exceeded 5000 mm.

Then, the pitch fiber bundle as stowed in the can was placed in the atmosphere of air having 5 vol. % of nitrogen dioxide gas incorporated in advance therein, heated therein from 150° C. to 300° C. at a temperature increasing rate of 1° C./min by blowing an oxidizing gas into the atmosphere through the lower part of the can, and retained therein at 300° C. for 30 minutes to afford infusibilized fibers. The infusibilized fibers as stowed in the can were heated in the atmosphere of nitrogen gas to 390° C. at a temperature increasing rate of 10° C./min and retained at this temperature for 30 minutes to effect low-temperature carbonization. When the fiber bundle was subjected to attempt firing at a temperature of 1100° C., with the fiber threads meanwhile paid out of the can into a furnace packed with the atmosphere of nitrogen gas, the fiber threads could not be stably paid out of the can because the fiber bundles each of 1000 filaments were divided into three bundles. The firing could not be carried out continuously because of the division of the fiber bundles within the carbonizing furnace.

EXAMPLE 3

Coal tar pitch deprived of quinoline insolubles and possessing a softening point of 80° C. was hydrogenated in the presence of a catalyst at a temperature of 360° C. under a pressure of 11.77 MPa to remove 40 wt. % of sulfur from the raw material. The resultant hydrogenated coal tar pitch was heat-treated at a temperature of 400° C. under a pressure of 5.33 KPa for five hours to afford pitch possessing a softening point of 160° C. The pitch resulting from the heat treatment was further treated at a temperature of 450° C. under a pressure of 66.66 Pa for five minutes to afford a spinning pitch. This pitch was identified as an optically isotropic pitch possessing a softening point of 250° C., a toluene insoluble content of 50 wt. %, and a quinoline insoluble content of 0 wt. % and containing absolutely no mesophase. The fibers drawn at a spinning viscosity of 40 Pa·s and a spinning speed of 400 m/min from the pitch by the use of two spinnerets each containing 1500 capillaries 0.1 mm in inside diameter were bound into two bundles each of 1500 filaments. The fiber bundles were each intertwined by exposure to currents of air blown at a speed of 3.5 m/s from two directions to afford two first fiber bundles. The two first fiber bundles were bound and exposed to currents of air blown at a speed of 50 m/s from eight directions to give rise to a second fiber bundle. This fiber bundle was stowed in a can. Thus, a continuous pitch fiber bundle of 3000 filaments having an average fiber diameter of 9.5 $\mu$m was obtained. In this pitch fiber bundle, the degree of intertwining within the first fiber bundles was 60 mm and the degree of intertwining between the adjacent first fiber bundles in the second fiber bundle was 2000 mm.

This pitch fiber bundle was treated in an atmosphere having a nitrogen dioxide concentration of 4 vol. % and an oxygen concentration of 30 vol. % at a temperature in the range of 120–240° C. for two hours and then treated in an atmosphere having a nitrogen dioxide concentration of 0.4 vol. % and an oxygen concentration of 10 vol. % at a temperature in the range of 240–330° C. for two hours (for a total of four hours). The infusibilized fiber bundle consequently obtained was placed in the atmosphere of nitrogen and subjected therein to low-temperature carbonization at 390° C. in the absence of tension. This fiber bundle was carbonized at 1000° C. as exposed, meanwhile, to a tension of 0.98 mN/tex to afford a carbonized fiber bundle. The fiber bundle resulting from this process and taken up on a bobbin was easily divided into two fiber bundles each of 1500 filaments. In this carbonized fiber bundle, the degree of intertwining within the first fiber bounds was 60 mm and the degree of intertwining between the adjacent first fiber bundles in the second fiber bundle exceeded 5000 mm.

The carbonized fiber bundle of 3000 filaments was rewound from the bobbin and graphitized in its unmodified form at a temperature of 2000° C. Thereafter, by dividing the fiber bundle by the use of a guide into fiber bundles each of 1500 filaments, it was made possible to stably produce two fiber bundles of 1500 filaments. This fiber bundle of 1500 filaments was found to have an average fiber diameter of 7.7 $\mu$m and suffered from neither rise of fluff nor dispersion of fiber size. The filament which forms the carbon fiber bundle was found to have tensile strength of 1.27 GPa, and a modulus of elasticity of 58.8 GPa.

EXAMPLE 4

The carbonized fiber bundle of 3000 filaments obtained in Example 3 and not divided into fiber bundles of 1500 filaments was graphitized at a temperature of 2000° C. to afford a carbon fiber bundle of 3000 filaments. This carbon fiber bundle could be divided into two fiber bundles each of 1500 filaments. In this fiber bundle, the degree of intertwining within the first fiber bundles remaining after removal of the sizing agent was 70 mm and the degree of intertwining between the adjacent first fiber bundles in the second fiber bundle exceeded 5000 mm. In the manufacture of a prepreg from the carbon fibers, by dividing the fiber bundle of 3000 filaments in front of a prepreg device into two fiber bundles of 1500 filaments, it was made possible to produce a UD prepreg having fiber areal weight of 30 g/m$^2$ and possessing a beautiful appearance free from loose weave.

The entire disclosures of Japanese Patent Application Nos. 11-089,062 filed on Mar. 30, 1999 and 2000-036,684 filed on Feb. 15, 2000 including specification, claims and summary are incorporated herein by reference in their entirety.

What is claimed is:

1. A method for the production of pitch type carbon fibers, said method comprising:

dividing a plurality of pitch fibers into a plurality of fiber bundles;

intertwining the plurality of fiber bundles by exposure to currents of air thereby forming a first fiber bundle;

binding a plurality of the first fiber bundles into a bound pitch fiber bundle;

intertwining a plurality of the bound pitch fiber bundles by exposure to currents of air; and drawing the plurality of bound pitch fiber bundles fibers as a second fiber bundle.

2. A method according to claim 1, further comprising infusibilizing and carbonizing the second fiber bundle and then dividing the such treated second fiber bundle into a plurality of first fiber bundles.

3. A method according to claim 1, further comprising infusibilizing and carbonizing the second fiber bundle and then graphitizing the such treated second fiber bundle after or while dividing the such treated fiber bundle into a plurality of first fiber bundles.

4. A method according to claim 1, further comprising infusibilizing, carbonizing, and graphitizing the second fiber bundle and then dividing the such treated second fiber bundle into a plurality first fiber bundles.

5. A method according to claim 1, wherein said intertwining by the currents of air is effected, during the formation of the first fiber bundle, by exposing a plurality of fiber bundles resulting from dividing a plurality of pitch fibers to currents of air blown at a speed in a range of 1 m/s–50 m/s from at least two directions and, during the formation of the second fiber bundle, by exposing a plurality of fiber bundles resulting from binding a plurality of first fiber bundles to currents of air blown at a speed in a range of 10 m/s–400 m/s from at least two directions.

6. A method for the production of pitch type carbon fibers, said method comprising firing a second fiber bundle while the second fiber bundle is exposed to tension in a range of 0.29 mN/tex–9.8 mN/tex during said carbonizing set forth in claim 2.

7. A method for the production of pitch type carbon fibers, said method comprising firing a second fiber bundle while the second fiber bundle is exposed to tension in a range of 0.29 mN/tex–9.8 mN/tex during said carbonizing set forth in claim 3.

8. A method for the production of pitch type carbon fibers, said method comprising firing a second fiber bundle while the second fiber bundle is exposed to tension in a range of 0.29 mN/tex–9.8 mN/tex during said carbonizing set forth in claim 4.

* * * * *